United States Patent [19]

Capone

[11] Patent Number: 5,020,158

[45] Date of Patent: Jun. 4, 1991

[54] BALL CATCHING TOY

[76] Inventor: Carmine K. Capone, 42 Mason St., Jefferson, N.J. 07849

[21] Appl. No.: 311,653

[22] Filed: Feb. 15, 1989

[51] Int. Cl.[5] ..... A41D 13/08

[52] U.S. Cl. ..... 2/19; 294/25

[58] Field of Search ..... 2/19, 158, 16, 159, 2/161 R, 161 A, 20, 21, 169, 163; 15/227; 294/25

[56] References Cited

U.S. PATENT DOCUMENTS

| | | | |
|---|---|---|---|
| 1,045,231 | 11/1912 | Whitley | 2/19 |
| 1,217,681 | 2/1917 | Baldridge | 2/20 X |
| 1,284,178 | 11/1918 | Clarke | 2/159 X |
| 1,426,824 | 8/1922 | Doak | 2/19 |
| 1,852,416 | 4/1932 | Kirkham | 2/19 |
| 2,521,488 | 9/1950 | Smith | 2/19 |
| 2,673,348 | 3/1954 | Du Chene | 2/161 R |
| 3,141,173 | 7/1964 | Jackson et al. | 2/19 |
| 3,953,030 | 4/1976 | Muchnick | 2/19 X |
| 4,532,653 | 8/1985 | Riaboff | 2/159 X |
| 4,700,405 | 10/1987 | Sternberg | 2/19 |

FOREIGN PATENT DOCUMENTS

| | | | |
|---|---|---|---|
| 1167307 | 11/1958 | France | 2/16 |

*Primary Examiner*—Werner H. Schroeder
*Assistant Examiner*—Sara M. Current
*Attorney, Agent, or Firm*—Hedman, Gibson, Costigan & Hoare

[57] ABSTRACT

A catching device made of a flexible material made to fit on the thumb and forefinger of a hand having a web which extends between the thumb and forefinger which is capable of freely moving from an open position, where the thumb and forefinger are apart, to a closed position, where the thumb and forefinger are together, or touching.

12 Claims, 2 Drawing Sheets

BALL CATCHING TOY

FIELD OF THE INVENTION

The invention relates to a toy which cooperates with and attaches to a hand to catch a ball or other similar object.

BACKGROUND OF THE INVENTION

The catching device perhaps best known in the art is a baseball glove. The baseball glove fits over the entire hand and all fingers and has a web between the forefinger and thumb. The baseball glove increases the ability of the wearer to catch a ball.

SUMMARY OF THE INVENTION

The present invention comprises a catching device comprising a web, which extends between a thumb and a forefinger on a hand having an extension which extends beyond the arch between the thumb and the forefinger of the hand, a means for attaching the web to the thumb and a means for attaching the web to the forefinger. The shape of the web of the present invention corresponds generally to the space between the thumb and the forefinger when the hand is fully opened.

The material of the device of the present invention is easily flexible for unrestricted movement of the fingers, including the thumb and forefingers, from a position where the thumb and forefinger are fully apart to a position where the thumb and forefinger are fully together or touching.

BRIEF DESCRIPTION OF THE DRAWINGS

The drawing figures described herein and attached hereto are intended merely to illustrate the present invention and are not intended to limit the invention in any manner whatsoever.

DESCRIPTION OF THE INVENTION

Figure 1:
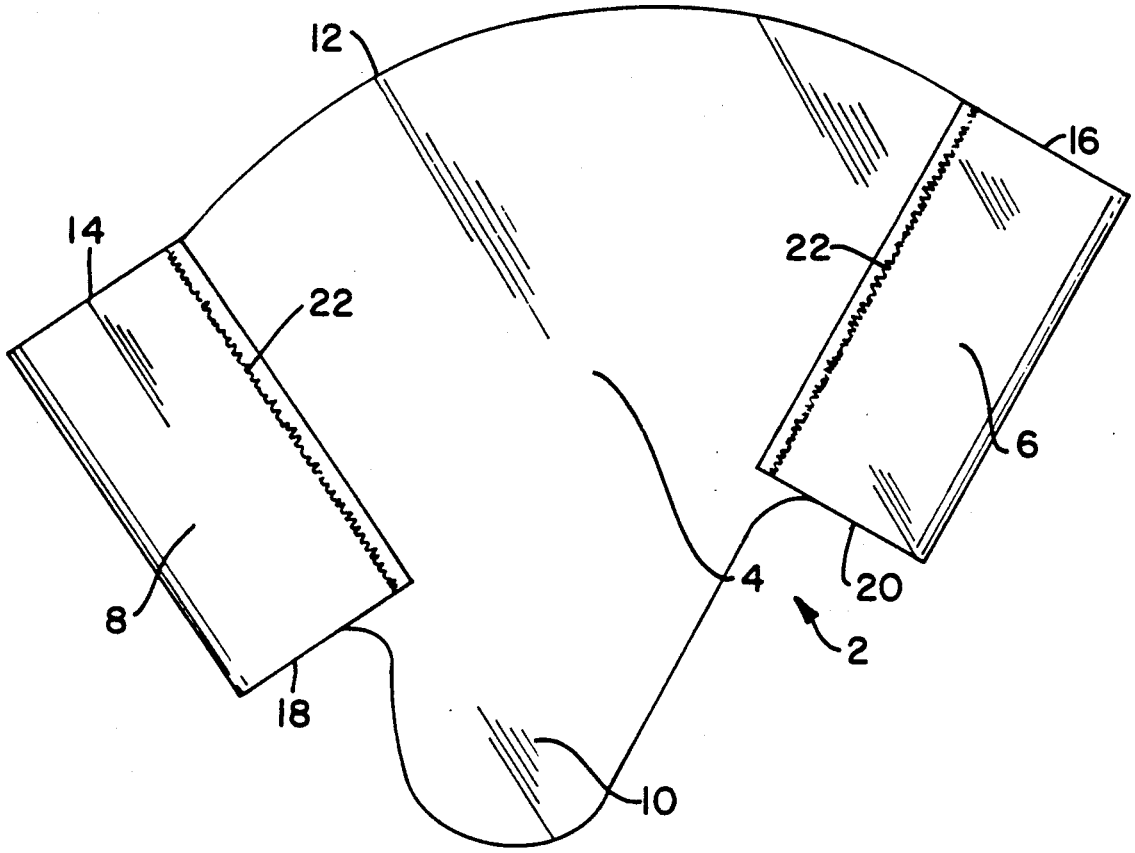
FIG. 1 is a front elevational view of the catching device of the present invention.
Figure 3:
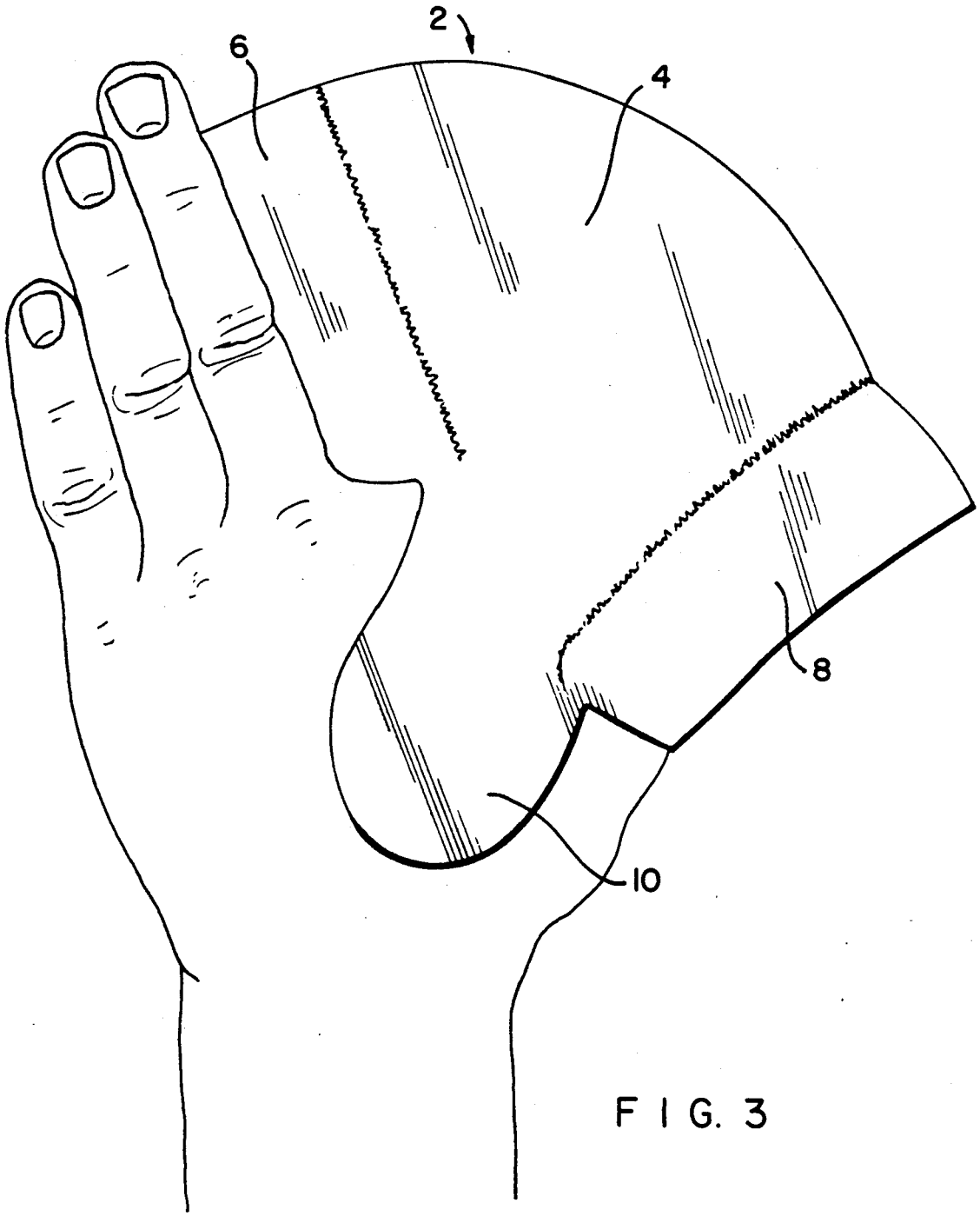
FIG. 3 is a plan view of the catching device of the present invention on a hand.

With reference to the drawings, and particularly FIGS. 1 and 3, the catching device comprises a web 4 terminating on one side with a means 6 for attaching the web to the forefinger of a hand and on the other side with a means 8 for attaching the web to the thumb of said hand.

At the bottom of the web 4 is an extension 10 which extends at least to some extent beyond the arch between the thumb and the forefinger of said hand to stop the object being caught from slipping under the web 4. The shape of the web 4 is made generally to correspond to the shape of the space between the thumb and the forefinger of a hand wherein the thumb and forefinger are fully apart. The top 12 of the web 4 can be of any shape, however, it is preferred that the top 12 be convex from the top 14 of the means 8 for attaching the web 4 to the thumb to the top 16 of the means 6 for attaching the web 4 to the forefinger.

Figure 2:
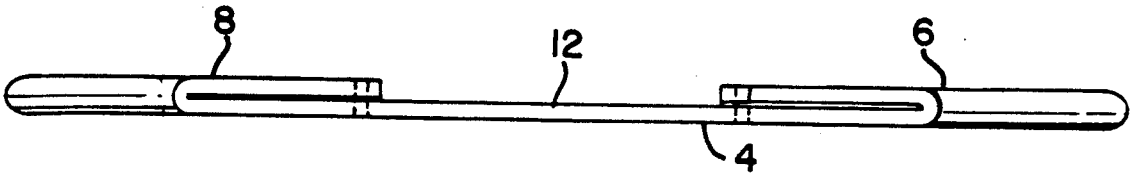
FIG. 2 is a top elevational view of the catching device of the present invention.

The means 6 for attaching the web 4 to the forefinger and the means 8 for attaching the web 4 to the thumb can be any means including one or more straps which surround the thumb and forefinger but preferably, as shown in FIGS. 1 and 2, is a circular or elliptical sleeve into which the thumb and forefinger are inserted into open ends 18 and 20 respectively. The means 6 and 8 for attaching the web 4 to the forefinger and thumb are attached to the web 4 by a means 22 of attachment. The means 22 to attach the means 6 and 8 can be any means, such as by stitching or sewing, stapling, gluing, a book and loop fastener such as VELCRO or even possibly heat sealing, depending on the material, etc., however stitching is preferred when the means 6 and 8 comprise an elastic or stretchable material.

The material of the catching device 2 can be any material or fabric which is flexible enough to allow virtually unrestricted movement of the thumb and forefinger from a fully open or apart position to a fully closed position, i.e., where the thumb and forefinger are touching. This allows the user to open the web 4 when the object to be caught, i.e., a ball, is approaching and to close the web 4, by bringing the thumb and forefinger together, when the approaching object contacts the web 4.

The material of the entire catching device 2 can be the same for the web 4 and the means 6 and 8 for attaching the web 4 to the forefinger and thumb, or the web 4 can be of a different material, however, it is preferred that the material used for the means 6 and 8 for attaching the web 4 to the forefinger and thumb be an elastic or stretchable material to allow said means 6 and 8 to fit many different size fingers. If the means 6 and 8 are not produced of an elastic or stretchable material the preferred means 22 of attachment is a hook and loop fastener such as VELCRO.

Although the catching device 2 of the present invention is described to fit the forefinger of the hand, it is understood that the means 6 for attaching the web 4 to the forefinger could as easily be used on any finger with the means 8 on the thumb.

While the invention has been described in detail and with reference to a specific embodiment thereof, it will be apparent to one skilled in the art that various changes and modifications can be made therein without departing from the spirit and scope thereof. For example, the tops 14 and 16 of the means for attaching the web 4 to the fingers can be closed or open and the means 6 and 8 for attaching the web 4 to the forefinger and thumb could comprise separate "straps" rather than a single sleeve which surrounds the entire finger. All such obvious variations are intended to be covered by the appended claims.

I claim:

1. A device for catching a ball or other similar object with a hand consisting of a flexible web, shaped substantially similar to the space between the thumb and forefinger when the thumb and forefinger are spread apart, having a top, a bottom which extends beyond the arch between the thumb and forefinger of the hand, and two sides, flexible means for engaging the user's thumb on one side of said web and flexible means for engaging the user's forefinger on the other side of said web exclusive of engagement with any other of the user's fingers wherein the web and the means for engaging the user's thumb and forefinger are comprised of one or more flexible materials.

2. The device of claim 1 wherein the means for engaging the user's thumb and forefinger are circular or elliptical sleeves into which the thumb and forefinger are inserted.

3. The device of claim 1 wherein the means for engaging the user's thumb and forefinger comprise one or more straps which encircle the thumb and one or more straps which encircle the forefinger.

4. The device of claim 1 wherein the flexible material of the means for engaging the user's thumb and forefinger is an elastic or stretchable material to allow said means to fit a variety of different size thumbs and forefingers.

5. The device of claim 4 wherein the web and the means for engaging the user's thumb and forefinger are comprised of the same elastic, flexible material.

6. The device of claim 1 wherein the means for engaging the user's thumb and forefinger are connected to the web by means for attachment.

7. The device of claim 6 wherein the means for attachment is taken from the group consisting of stitching or sewing, gluing, stapling, heat sealing and hook and loop fasteners.

8. The device of claim 7 wherein the means for attachment comprises stitching or sewing.

9. The device of claim 1 wherein the top of the web is convex from the top of the means for engaging the user's thumb to the top of the means for engaging the user's forefinger to provide optimum surface area of the web.

10. The device of claim 1 wherein the web and the means for engaging the user's thumb and forefinger are comprised of the same flexible material.

11. The device of claim 1 wherein the material of the web and means for engaging the user's thumb and forefinger is neoprene.

12. The device of claim 1 wherein the web and the means for engaging the user's thumb and forefinger are comprised of a single piece of neoprene folded over at the sides of the web and stitched in proximity to said fold to create sleeves for engaging the user's thumb and forefinger.

* * * * *